US005650048A

United States Patent [19]

Swietlik

[11] Patent Number: 5,650,048

[45] Date of Patent: Jul. 22, 1997

[54] EXTENDED NIP PRESS WITH HYDRAULIC PRESSURE EQUALIZER VALVE

[75] Inventor: Francis X. Swietlik, Rockton, Ill.

[73] Assignee: Beloit Technologies, Inc., Wilmington, Del.

[21] Appl. No.: 595,000

[22] Filed: Jan. 31, 1996

[51] Int. Cl.[6] ..... D21F 3/06

[52] U.S. Cl. ..... 162/358.3; 162/361; 496/7; 496/20

[58] Field of Search ..... 162/358.3, 358.4, 162/358.5, 361, 205; 492/7, 16, 20

[56] References Cited

U.S. PATENT DOCUMENTS

| | | | |
|---|---|---|---|
| Re. 31,923 | 6/1985 | Justus et al. | 162/358.3 |
| 4,328,744 | 5/1982 | Pav et al. | 100/162 B |
| 4,425,190 | 1/1984 | Cronin | 162/358 |
| 4,427,492 | 1/1984 | Cronin | 162/358 |
| 4,428,797 | 1/1984 | Cronin | 162/358 |
| 4,661,206 | 4/1987 | Heitmann et al. | 162/358.3 |
| 4,713,147 | 12/1987 | Saarinen | 162/358 |
| 5,043,046 | 8/1991 | Laapotti | 162/358.3 |
| 5,071,513 | 12/1991 | Bluhm et al. | 162/206 |
| 5,140,897 | 8/1992 | Olson | 100/153 |
| 5,167,768 | 12/1992 | Cronin et al. | 162/205 |
| 5,389,205 | 2/1995 | Pajula et al. | 162/205 |
| 5,423,949 | 6/1995 | Ilmarinen | 162/358.3 |

FOREIGN PATENT DOCUMENTS

| | | | |
|---|---|---|---|
| 93/23614 | 11/1993 | WIPO | 162/358.3 |

*Primary Examiner*—Donald E. Czaja
*Assistant Examiner*—Jose A. Fortuna
*Attorney, Agent, or Firm*—Dirk J. Veneman; Raymond W. Campbell; David J. Archer

[57] ABSTRACT

An extended nip press has a shoe driven by two pistons to engage a blanket-supported web against a crown controlled roll. Each ENP shoe piston is offset from the line of force application of the crown control piston by a moment arm distance. A balancing of the hydraulic pressures in the ENP shoe cylinders and the crown control cylinder is achieved by two equalizer valves. Each valve has a slidable spool with faces of a selected cross-sectional area to respond to hydraulic fluid from the various cylinders to retain the correct proportion between the forces applied by the ENP shoe pistons and the crown control piston.

4 Claims, 3 Drawing Sheets

EXTENDED NIP PRESS WITH HYDRAULIC PRESSURE EQUALIZER VALVE

FIELD OF THE INVENTION

The present invention relates to papermaking machinery in general, and to extended nip presses for paper manufacturing applications in particular.

BACKGROUND OF THE INVENTION

As the manufacturing of paper has improved over time, a major factor in increasing the cost effectiveness with which paper is manufactured has been the increase in machine speed. A critical problem with increased machine speed is the difficulty in increasing drying speed without increasing the number of dryers proportional to the higher machine speeds. A major advance in increasing the dryness of the web as it leaves the pressing section of the papermaking machine was achieved through the introduction of extended nip presses.

An extended nip press utilizes a shoe which is forced against a backing roll. A conventional press roll will have a nip of no more than about one to two inches in width, while an extended nip will have a width of about ten inches.

Extended nip presses can increase the dryness of the web with fewer nips, thus resulting in a shorter papermaking machine. A shorter papermaking machine occupies less space and generally has fewer components thereby contributing to lower costs.

Extended nip presses can also contribute to enhancing the bulk properties of the paper and the surface finish of the final web. To get maximum control over the affect which the extended nip press has on the web, it is desirable to be able to control the shape of the pressure profile the web is subjected to as it moves through the nip formed between the shoe and the backing roll. In order to gain better contact over the extended nip the shape of the shoe may be varied and the shoe can be supported on two spaced apart pistons. But with greater controllability comes greater complexity and the possibility of instabilities in the control system.

What is needed is a control system for controlling the forces generating the pressure profile of an extended nip press which has inherent simplicity and reliability.

SUMMARY OF THE INVENTION

An extended nip press has a shoe driven by two pistons to engage a blanket-supported web against a crown controlled roll. Each ENP shoe piston is offset from the line of force application of the crown control piston by a moment arm distance. A balancing of a resultant force of the pistons produced by the hydraulic pressures in the ENP shoe cylinders and the resultant force produced by the piston in the crown control cylinder is achieved by two equalizer valves. Each valve has a slidable spool with faces of a selected cross-sectional area to respond to hydraulic fluid from the various cylinders to retain the correct proportion between the forces applied by the ENP shoe pistons and the crown control piston.

One equalizer valve has a spool with surface areas to insure that the product of the force applied and the moment arm of each one of the ENP shoe pistons is a fixed ratio. A second equalizer valve has a spool with surface areas to insure that the forces applied by the two ENP shoe pistons are equivalent to the force applied by the controlled crown shoe piston. This hydraulic control system makes it possible to adjust the force level in a single ENP shoe cylinder, with the remaining ENP shoe cylinder and the crown control cylinder automatically following.

It is a feature of the present invention to provide an extended nip press apparatus in which the multiple hydraulic pistons operating on the ENP shoe are automatically controlled to remain in balance with a crown controlled roll piston.

It is an additional feature of the present invention to provide an extended nip press apparatus in which the levels of fluid pressure in multiple hydraulic pistons applied to the ENP shoe and the crown controlled roll may be retained in balance at various selected overall force levels.

It is another feature of this invention to provide a system of hydraulic equalizer valves for an ENP and crown controlled roll apparatus which automatically maintain desired force relationships.

Further objects, features and advantages of the invention will be apparent from the following detailed description when taken in conjunction with the accompanying drawings.

DESCRIPTION OF THE PREFERRED EMBODIMENT

Figure 1:
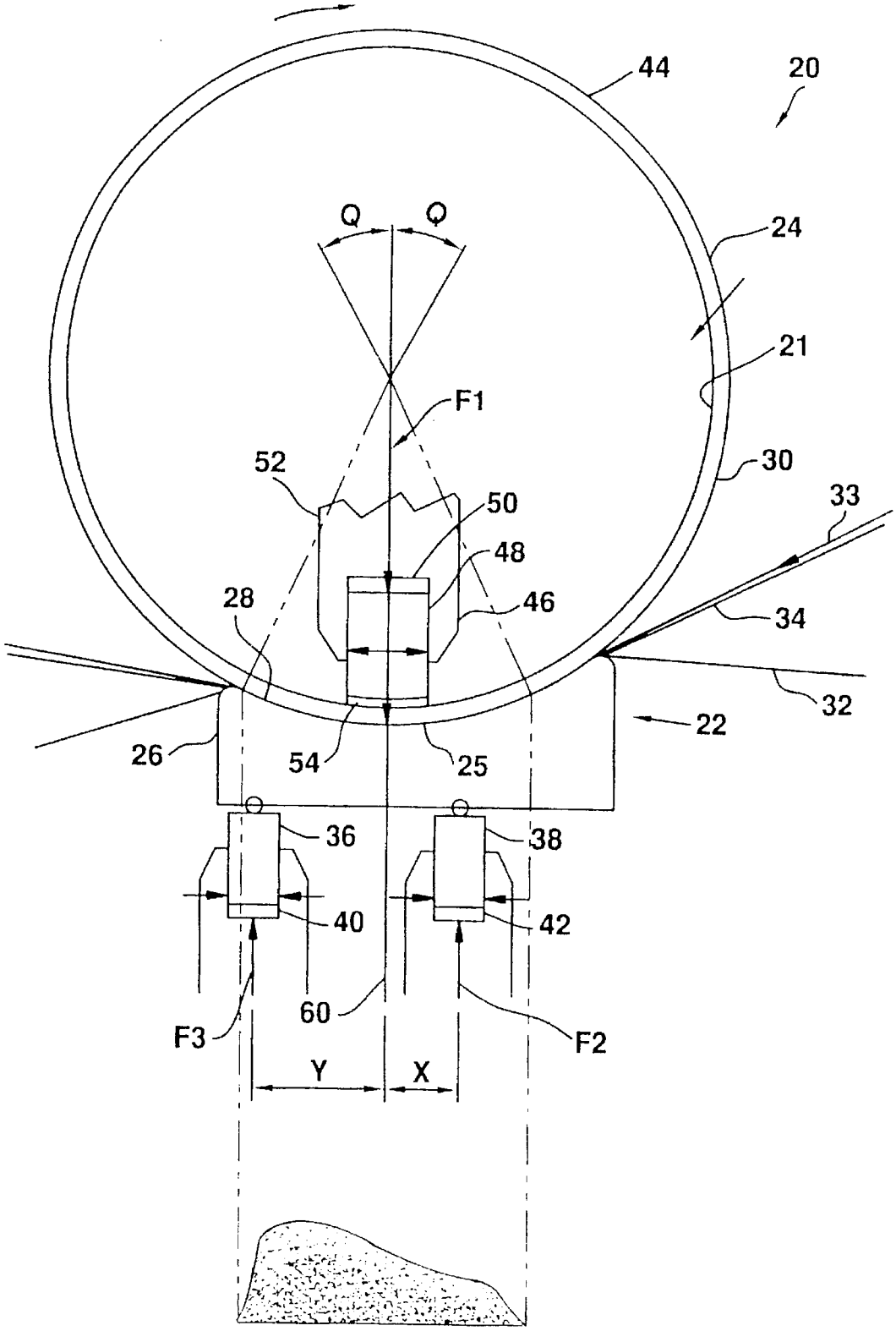
FIG. 1 is a schematic view of an extended nip press and crown-controlled roll apparatus of this invention.

Referring more particularly to FIGS. 1–4, wherein like numbers refer to similar parts, an extended nip press apparatus 20 with hydraulic control is shown in FIG. 1. The apparatus 20 has an extended nip press (ENP) 22 with a crown controlled roll 24 which is opposed to an ENP shoe 26. The shoe has a concave surface 28 which conforms to the outer cylindrical surface 30 of the crown controlled roll 24 and forms a nip 25 between the roll 24 and the ENP shoe 26. A continuous looped blanket 32 extends through the nip 25 between the roll 24 and the shoe 26. A press felt 34 passes over the blanket 32, and a paper web 33 is supported on the felt as the blanket 32, felt 34, and web 33 pass through the nip 25. The ENP shoe 26 is supported and urged against the surface 30 of the roll 24 by a first hydraulic piston 38 and a second hydraulic piston 36 which move in piston cavities 42, 40. The piston cavities 42, 40 are formed in a non-rotating support beam, not shown. Extended nip presses are well known in the papermaking art, and are typically utilized in the pressing and drying of a paper web in the pressing or drying sections of a papermaking machine.

The crown controlled roll 24 has an outer shell 44 which is supported on a plurality of hydraulic cylinders 46 with support pistons 48. The support pistons 48 are positioned in piston cavities 50 in a lateral support beam 52. Each piston 48 has a support surface or shoe 54 which engages the inner surface 21 of the outer shell 44 and controls the position of the roll 24 at the nip 25 where it meets the ENP shoe 26 to press the web therebetween in a consistent manner.

Because two pistons 36, 38 are used to advance the ENP shoe 26 against the roll 24, it is necessary to keep the total force of the ENP shoe 26 against the roll equal to the force of the crown controlled roll against the shoe. This maintenance of forces is obtained by a first equalizer valve 56 shown in FIG. 2, and a second equalizer valve 58 shown in FIG. 3.

The pressure level to the piston 38 at the wet end of the ENP shoe 26 is set at a selected level to suit the particular application of the ENP press apparatus 20. For example, different qualities of paper may require different levels of pressure on the ENP shoe 26. While the pressure to the wet end piston 38 is selected, the pressure to the piston 36 at the dry end of the shoe is controlled by the equalizer valve 56.

A simple force diagram, shown in FIG. 1, indicates the desired relationship between the pressures on the wet end piston 38 and the dry end piston 36. For consistent performance, a fixed ratio is established between the moments applied by the two pistons 36, 38 with respect to the central line 60 of the resultant force of the controlled crown piston 48, which is to say the force F2 applied by the wet end piston 38 multiplied by the moment arm distance X between the point of application of the force F2 and the central line 60 will have a fixed ration with respect to the force F3 applied by the dry end piston 36 multiplied by the moment arm distance Y between the point of application of the force F3 and the central line 60:

$$F3(Y)/F2(X)=\text{constant}$$

Figure 2:
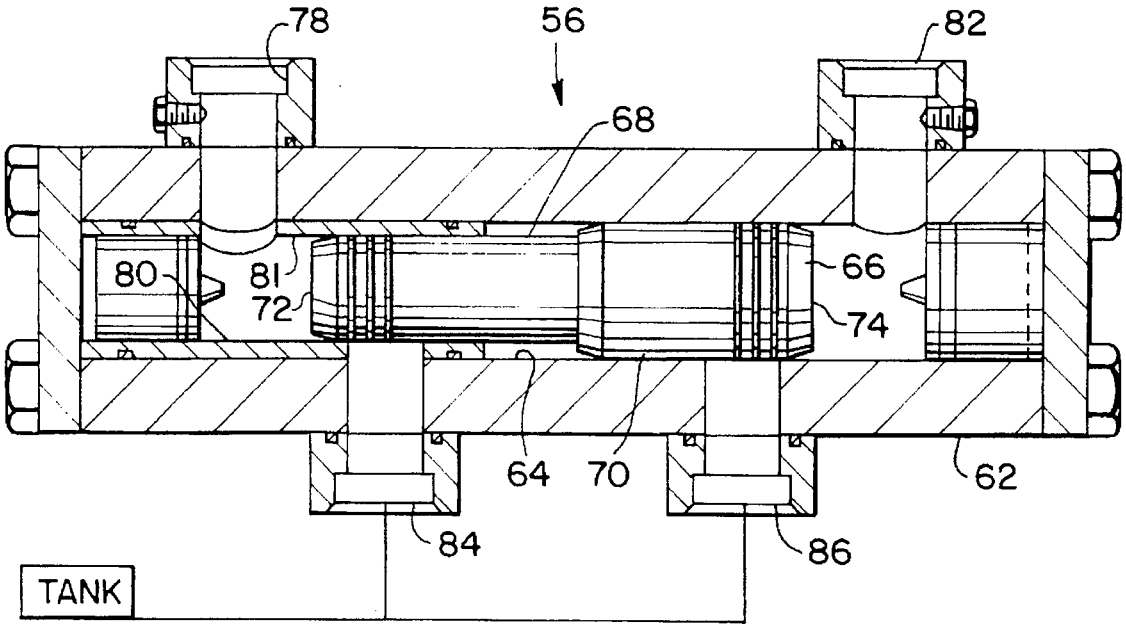
FIG. 2 is a cross-sectional view of an equalizer valve assembly of the apparatus of FIG. 1.
Figure 3:
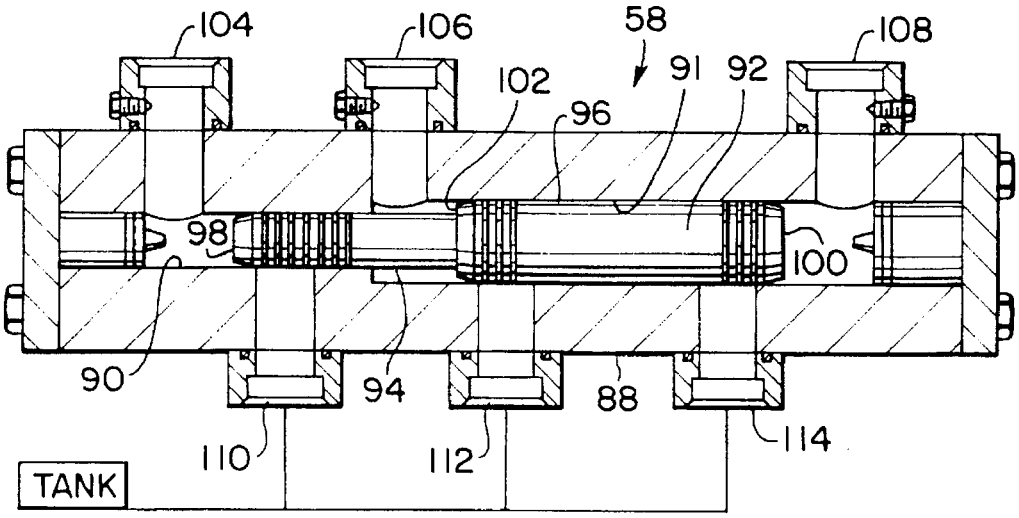
FIG. 3 is a cross-sectional view of another equalizer valve assembly of the apparatus of FIG. 1.

The first equalizer valve 56, shown in FIG. 2, maintains the desired relationships between the forces F3 and F2.

The pistons 36, 38, 48 in the illustrated embodiment are rectangular pistons which may have an exemplary width in the dry end piston 36 and the wet end piston 38 of three inches, and in the crown control piston of six inches. The pistons extend the full width of the ENP and the crown control roll, which may be a length of thirty to four hundred inches. Alternatively, a plurality of smaller pistons may be employed.

The equalizer valve 56 has a valve body 62 with a central cylindrical cavity 64 in which a free piston or spool 66 is slidably mounted. The spool 66 has several unbalanced movable surfaces which form portions of variable size chambers within the valve body 62. The cavity 64 defines a larger diameter cylinder. The spool 66 has a narrow diameter portion 68 connected to a larger diameter portion 70. The larger diameter portion 70 fits within the larger diameter cylinder defined by the cavity 64. A first area A1 is defined by the face 72 of the narrow diameter portion 68, and a second area A2 is defined by the face 74 of the larger diameter portion 70.

A sleeve 80 is fixed to the valve body 62 within the cavity 64, and defines a narrow diameter cavity 81. The equalizer valve 56 has a wet end piston port 78 extending from the narrow diameter cavity 81. The port 78 is in fluid communication with the wet end piston cylinder 42, such that the pressure in the wet end piston cylinder is exerted against the narrow diameter face 72 of the spool 66. The fluid entering the port 78 acts only on the narrow diameter face 72 of the spool 66.

A dry end piston port 82 extends from the valve body 62 and defines a fluid communication between the cavity 64 and the dry end piston cylinder 40, such that the pressure in the dry end piston cylinder 40 is exerted against the large diameter face 74 of the spool 66. A first drain port 84 extends from the cavity 64, such that movement of the spool toward the dry end piston port 82 will connect the first drain port 84 with the wet end piston port 78, and thereby drain hydraulic fluid from the wet end piston cylinder 42. A second drain port 86 extends from the cavity 64 such that movement of the spool toward the wet end piston port 78 will connect the second drain port with the dry end piston port 82, and thereby drain hydraulic fluid from the dry end piston cylinder 40.

The ratio of the areas A1 :A2 is selected to achieve the desired force ratio between forces F2:F3, hence the force applied to the small diameter face of the spool will be P1 (A1), which will be equal to the force applied to the larger diameter face of the spool, P2(A2). When this relation does not apply, one or the other of the drain ports 84, 86, will be uncovered and the over-high pressure will be reduced until the desired force relationship on the two ENP shoe pistons is attained.

To maintain a proper force relationship, it is also important that the sum of the forces applied by the two ENP pistons 36, 38 be equal to the force applied by the controlled crown piston 48. This relationship is controlled by the second equalizer valve 58 shown in FIG. 3.

The equalizer valve 58 has a valve body 88 with a central cylindrical cavity formed of a small diameter section 90 and a larger diameter section 91 in which a free piston or spool 92 is slidably mounted. The spool 92 has a narrow diameter portion 94 connected to a larger diameter portion 96. A first area A3 is defined by the face 98 of the narrow diameter portion 94, and a second area A4 is defined by the face 100 of the larger diameter portion 96. A third area A5 is defined by the annular face 102 defined where the narrow diameter portion 94 is connected to the larger diameter portion 96.

The equalizer valve 58 has a dry end piston port 104 extending from the cavity small diameter section 90. The port 104 is in fluid communication with the dry end piston cylinder 40, such that the pressure in the dry end piston cylinder is exerted against the narrow diameter face 98 of the spool 92. Hence the fluid entering the port 104 acts only on the narrow diameter face 98 of the spool 92.

A wet end piston port 106 extends from the cavity larger diameter section 91, and is in fluid communication with the wet end piston cylinder 42, such that the pressure in the wet end piston cylinder 42 is exerted against the annular face 102 of the spool 92.

A controlled crown port 108 extends from the cavity larger diameter section 91, and is in fluid communication with the controlled crown piston cylinder 50, such that the pressure in the controlled crown piston cylinder is exerted against the larger diameter face 100 of the spool 92. Drains 110, 112, 114 are positioned to extend from the small diameter section 90, and the larger diameter section 91 to be selectably in communication with the dry end port 104, the wet end piston port 106, and the crown control piston port 108 respectively. In an equilibrium position, none of the drain ports 110, 112, 114 are uncovered, and the forces exerted on the small diameter face and the annular surface are equal to the force exerted on the larger diameter face. The areas A3 and A4 will thus be selected so that when multiplied by the pressures in the dry end cylinder and the wet end cylinder respectively and added together, the sum will be equal to the pressure in the crown control roll cylinder multiplied by AS:

$$A3(\text{Pressure in wet end piston cylinder})+A4(\text{Pressure in dry end piston cylinder})=A5(\text{Pressure in crown control roll cylinder})$$

Should this desired ratio become unbalanced, the spool will shift, and the appropriate cylinders will be drained until the desired equilibrium is reached.

Figure 4:
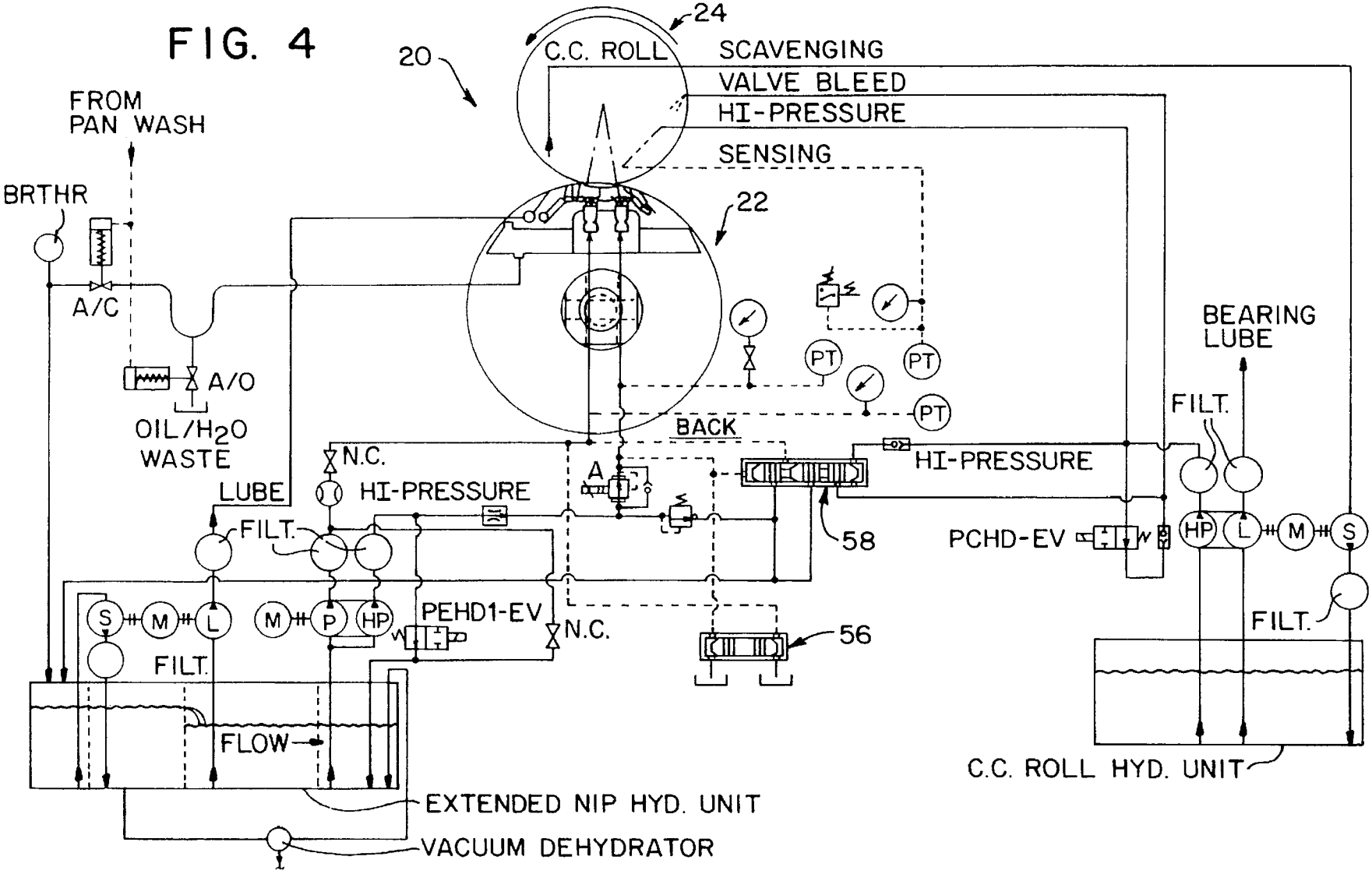
FIG. 4 is a schematic hydraulic diagram of the apparatus of FIG. 1.

An exemplary hydraulic installation of the system 20 is shown in FIG. 4.

It should be noted that alternative equalizer valve arrangements having the equivalent function may be employed. For example, a valve housing having a plurality of linked pistons of selected surface areas may be employed, rather than a single free piston. In addition, pistons of like diameter, but having varying moment arms linked mechanically to adjustment or bleed-off valves may be employed to achieve the desired relationship between pressure levels in the controlled hydraulic assembly.

It is understood that the invention is not limited to the particular construction and arrangement of parts herein illustrated and described, but embraces such modified forms thereof as come within the scope of the following claims.

I claim:

1. A hydraulically supported extended nip web press apparatus for use in a papermaking machine, including a paper web, a blanket, and a press felt, the apparatus comprising:

a crown controlled roll having a cylindrical shell with interior and exterior surfaces, and a support beam, the roll extending in a cross-machine direction of the papermaking machine;

an extended nip press shoe for engagement with the blanket over the exterior surface of the shell to form an extended nip in the cross-machine direction, wherein the extended nip press shoe is supported on a shoe support beam which extends in the cross-machine direction, and wherein a first piston and a second piston provide support between the beam and the extended nip press shoe and wherein the first and second pistons are spaced apart in a machine-direction perpendicular to the cross-machine direction;

a crown support piston disposed within the crown controlled roll and positioned between the roll support beam and the roll shell and having a roll support shoe for acting outwardly against the interior surface of the shell towards the extended nip;

a first means for supplying hydraulic pressure to the crown control roll support piston;

a second means for supplying hydraulic pressure to the first support piston;

a third means for supplying hydraulic pressure to the second support piston;

a first hydraulic control valve for operatively hydraulically linking the first and second means for supplying hydraulic pressure in a fixed ratio therebetween;

a second hydraulic control valve having a first chamber in hydraulic communication with the first support piston, a second chamber in hydraulic communication with the second support piston, and a third chamber in hydraulic communication with the crown support piston, wherein the first chamber has a first unbalanced movable surface, the second chamber has a second unbalanced movable surface, and the third chamber has a third unbalanced movable surface, wherein the third chamber has a bleed port which is openable in response to movement of the third unbalanced surface; and wherein the first unbalanced movable surface, the second unbalanced movable surface and the third unbalanced movable surface are mechanically linked and the first, second, and third unbalanced movable surfaces have areas selected so the hydraulic pressure in the first support piston times the surface area of the first unbalance surface, plus the pressure in the second support piston times the area of the second unbalanced surface will move the third unbalanced surface causing the bleed port to close until the pressure in the crown support piston times the area of the crown support piston shown, is equal to the hydraulic pressure in the first support piston times the surface area of the first piston, plus the pressure in the second support piston times the area of the second support piston.

2. The apparatus of claim 1 wherein the second hydraulic control valve further comprises:

a free piston, the free piston having a first end positioned in the first chamber, the first end forming the first unbalanced movable surface and creating a first force for movement of the piston in response to hydraulic pressure in the first chamber, portions of the free piston defining a second end opposite the first end and positioned in the third chamber and forming the third unbalanced movable surface, wherein a portion of the free piston adjacent the third unbalanced surface is operable to open and close the bleed port in response to motions of the free piston; and portions of the free piston defining an annular surface positioned in the second chamber and forming the second unbalanced movable surface, wherein the annular surface develops a force in response to hydraulic pressure in the second chamber which acts in the same direction as the force developed by the first unbalanced surface.

3. A hydraulically supported extended nip web press apparatus for use in a papermaking machine, including a paper web, a blanket, and a press felt, the apparatus comprising:

a roll rotatable about an axis;

an extended nip press shoe fop engagement with the blanket over the roll to form an extended nip aligned with the axis of the roll, the nip having a selected central line extending in the cross machine direction, wherein the extended nip press shoe is supported on a shoe support beam which extends parallel to the nip and in the cross machine direction, end wherein a first support piston and a second support piston provide support between the beam and the extended nip press shoe, and wherein the first support piston and the second support piston are spaced apart in a machine direction on either side of the central line;

a first means for supplying hydraulic pressure to the first support piston;

a second means for supplying hydraulic pressure to the second support piston;

a first hydraulic control valve for operatively hydraulically linking the first and second means for supply hydraulic pressure in a fixed ratio therebetween;

a second hydraulic control valve having a first chamber in hydraulic communication with the first support piston, and a second chamber in hydraulic communication with the second support piston, wherein the first chamber has a first unbalanced movable piston surface and wherein movement of the first piston surface is linked to the opening and closing of a first bleed port, and wherein the second chamber has a second unbalanced movable surface, wherein movement of the second piston surface is linked to the opening and closing of a second bleed port, and wherein the first unbalanced movable piston surface and the second unbalanced movable piston surface are mechanically linked, and wherein the areas of the first unbalanced surface and the second unbalanced surface are chosen so that the area of the first piston times the pressure of the hydraulic fluid on the first piston, to produce a first force, times the distance in the machine direction of the first piston from the central line has a fixed ratio to the hydraulic pressure on the second piston times the area of the second piston, to produce a second force, times the distance in the machine direction of the second piston from the central line, the first and second bleed ports being positioned so they are substantially closed when the first and second forces are in the desired proportion about the central line, and the bleed ports being positioned so that each port is substantially open when the pressure in the corresponding cylinder is too high.

4. A papermaking apparatus comprising:

a crown controlled roll having a cylindrical roll shell having inner and outer surfaces, and at least one hydraulically actuated crown control piston in a crown control hydraulic cylinder, the piston having a roll support shoe which engages against the inner surface of the roll shell;

an extended nip press shoe for engagement with a blanket against the exterior surface of the roll shell;

a first hydraulic cylinder having a first piston which engages the extended nip press shoe;

a second hydraulic cylinder having a second piston which engages the extended nip press shoe at a position spaced in the machine direction from the first piston;

a first equalizer valve having a valve body with portions defining a cavity having a narrow diameter cylindrical portion in communication with a larger diameter cylindrical portion, wherein the first equalizer valve is in fluid communication with the first hydraulic cylinder, the second hydraulic cylinder, and the crown control hydraulic cylinder;

a first free piston positioned within the first equalizer valve cavity, wherein the first free piston has a narrow diameter face which extends within the narrow diameter cylindrical portion such that the narrow diameter face is in fluid communication with the hydraulic fluid in the first shoe hydraulic cylinder, and wherein the first free piston has a larger diameter face which extends within the larger diameter cylindrical portion of the cavity and is in fluid communication with the crown control hydraulic cylinder, and the first free piston has an annular region between the narrow diameter face and the larger diameter face which is in communication with the second shoe hydraulic cylinder, wherein the first free piston is movable in response to the pressures applied to the narrow diameter face, the larger diameter face and the annular face, to alternatively discharge hydraulic fluid from the first shoe hydraulic cylinder and the second shoe hydraulic cylinder or the crown control hydraulic cylinder through drain ports to thereby retain a selected relationship between the forces applied by the support shoe of the crown control piston and the first and second pistons engaging the extended nip press shoe; and a second equalizer valve having a second free piston movable within the second equalizer valve and in fluid communication with the first cylinder and the second cylinder, wherein the second free piston has faces of surface area selected such that the force of the first piston times the moment arm of the first piston with respect to a line passing through the point of application of the force of the crown control piston will be at a fixed ratio to the force of the second piston times the moment arm of the second piston with respect to said line passing through the point of application of the force of the crown control piston.

* * * * *